United States Patent [19]

Fenton

[11] 4,076,976

[45] Feb. 28, 1978

[54] FLASH ASSEMBLY FOR CLOTHING-SUPPORTED JEWELRY

[76] Inventor: Russell S. Fenton, 308 Eaton St., Northfield, Ill. 60062

[21] Appl. No.: 745,366

[22] Filed: Nov. 26, 1976

[51] Int. Cl.[2] ..... F21V 33/00

[52] U.S. Cl. ..... 362/104

[58] Field of Search ..... 240/6.4 W, 6.4 R; 63/20

[56] References Cited

U.S. PATENT DOCUMENTS

| | | | |
|---|---|---|---|
| 3,384,740 | 5/1968 | Wood | 240/6.4 W |
| 3,805,047 | 4/1974 | Dockstader | 240/6.4 W |
| 3,866,035 | 2/1975 | Richey, Jr. | 240/6.4 W |

*Primary Examiner*—L. T. Hix
*Assistant Examiner*—M. L. Gellner
*Attorney, Agent, or Firm*—Leydig, Voit, Osann, Mayer & Holt, Ltd.

[57] ABSTRACT

An assembly for causing a piece of jewelry to emit a flashing light in which a miniature circuit board has a pair of sockets presenting spaced pin-receiving openings. Cooperating with the openings is a jewelry mounting plate having a light-emitting diode mounted on the face thereof and having a pair of sharp stiff pins of small diameter connected to the diode and spaced to coincide with the socket openings. Mounted upon the circuit board is a module in the form of an integrated oscillator circuit having its input connected to a battery and its output connected to the sockets. The sockets provide frictional retention of the pins so that upon entry of the pins into the sockets, with a layer of clothing in between, the circuit board and mounting plate are mutually captive, with the pins completing a circuit between the light-emitting diode and the output of the oscillator for periodic flashing. The piece of jewelry is mounted upon the mounting plate integrated with the light-emitting diode. Preferably the circuit board is enclosed within a small, conforming plastic box, with the front of the box having clearance openings for the pins. A switch having an arm extending through the edge of the box is preferably provided for disconnecting the battery during periods of non-use.

5 Claims, 9 Drawing Figures

FLASH ASSEMBLY FOR CLOTHING-SUPPORTED JEWELRY

It is the purpose of the present invention to make clothing-supported jewelry, including fraternal jewelry, more attractive and attention-getting. This is accomplished by integrating the jewelry with a flashing, light-emitting diode. In the past efforts to illuminate jewelry with a flashing light have been generally unsuccessful because of the need for heavy batteries, external wires and the like.

It is an object of the present invention to provide a flash assembly for clothing-supported jewelry which is formed of two subassemblies, one being a circuit board mounting an oscillator with a pair of sockets at the output of the oscillator and the other being a jewelry mounting plate carrying a light-emitting diode and having a pair of sharp, stiff pins which penetrate a layer of clothing to provide simultaneous support and electrical contact for completing a connection between the oscillator and the light-emitting element.

It is a more general object of the present invention to provide a flash assembly having a jewelry mounting plate carrying a light-emitting diode and onto which the jewelry may be cemented or otherwise secured in integrated relation so that the diode, by its illumination, adds interest and attractiveness. It is an object in this connection to provide a flash assembly for clothing-supported jewelry which may be universally used with almost any type of jewelry, by way of example, a fraternal emblem in the case of a man, a representation of a firefly in the case of a woman, or "Rudolph the Reindeer" in the case of a child.

It is another object of the invention to provide a flash assembly for clothing-supported jewelry employing an oscillator-and-battery power source in which the oscillator and battery are both highly miniaturized in a flat configuration so that upon being hidden behind a layer of clothing the source does not reveal itself by any noticeable bulk or outline. Thus it is a related object to provide a piece of illuminated novelty jewelry which can be worn comfortably on an indefinite basis and which is, indeed, more easily put on and taken off than conventional jewelry using conventional types of clasps or attachments. Moreover, in spite of the fact that the two portions of the assembly are interconnected by means of sharpened pins, the pins are both secure and safe.

It is yet another object to provide a flash assembly for illumination of jewelry which produces a bright, eye-catching flash but which nevertheless has such a low average power drain that a battery of the hearing aid type will last for a period of months in normal usage.

Other objects and advantages of the invention will become apparent upon reading the attached detailed description and upon reference to the drawing in which.

Figure 1:
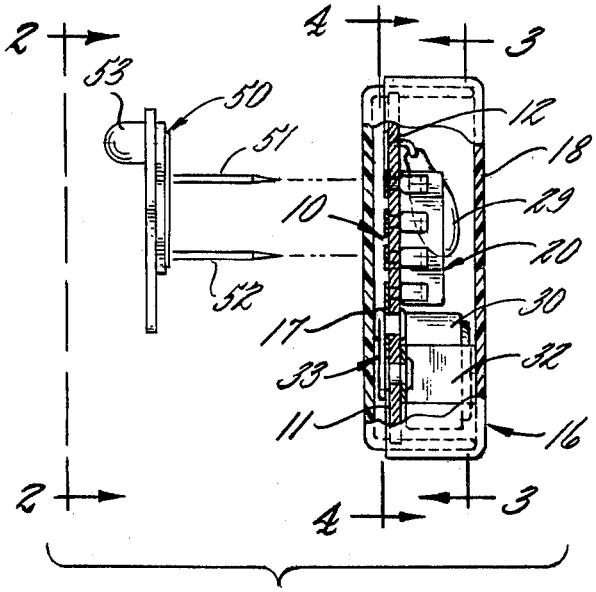
FIG. 1 is an enlarged cross sectional view of a flash assembly constructed in accordance with the invention taken along the line 1—1 in FIG. 3.
Figure 2:
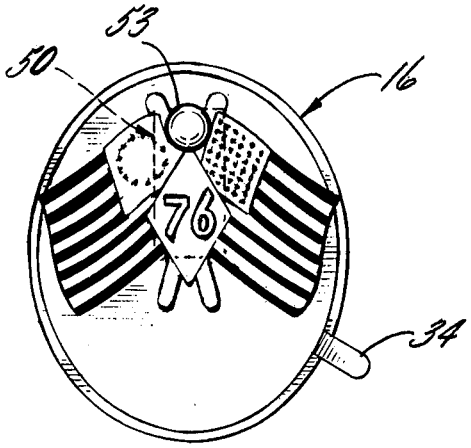
FIG. 2 is a front view of the front flash assembly showing the light-emitting diode integrated with a piece of jewelry having a patriotic motif.
Figure 3:
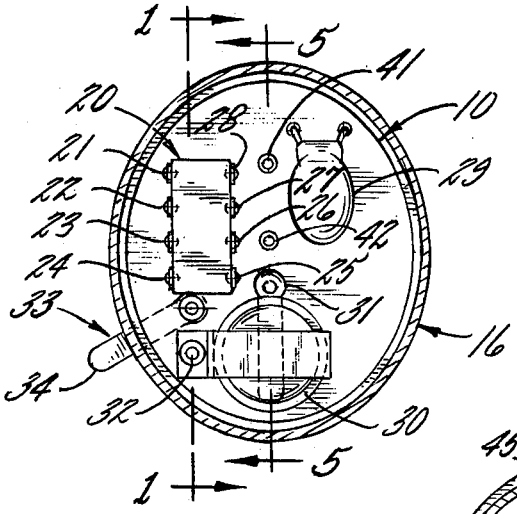
Figure 2A:
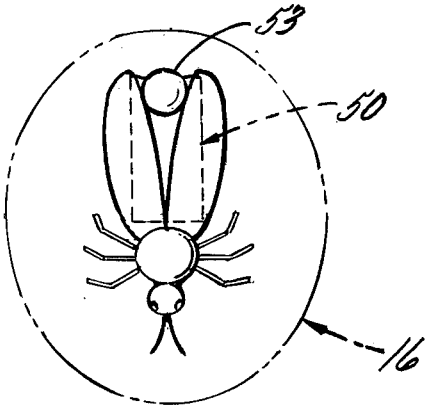
Figure 4:
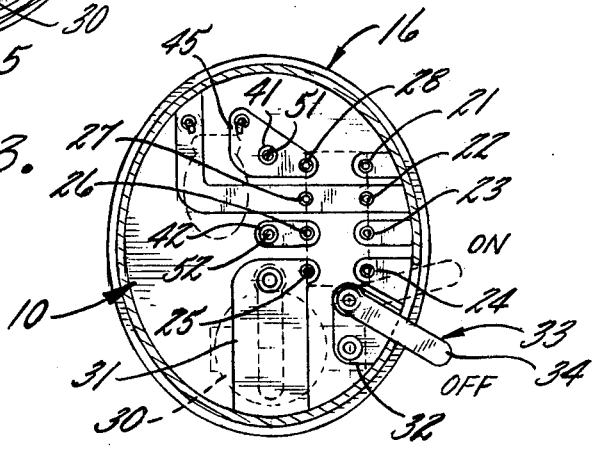
Figure 5:
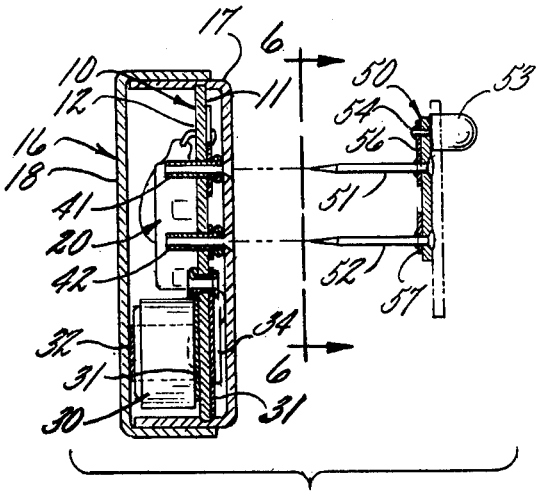
Figure 6:
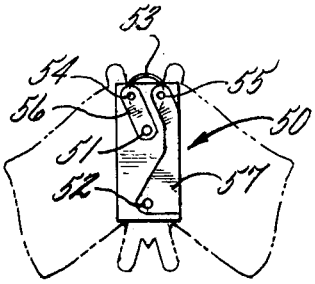
Figure 7:
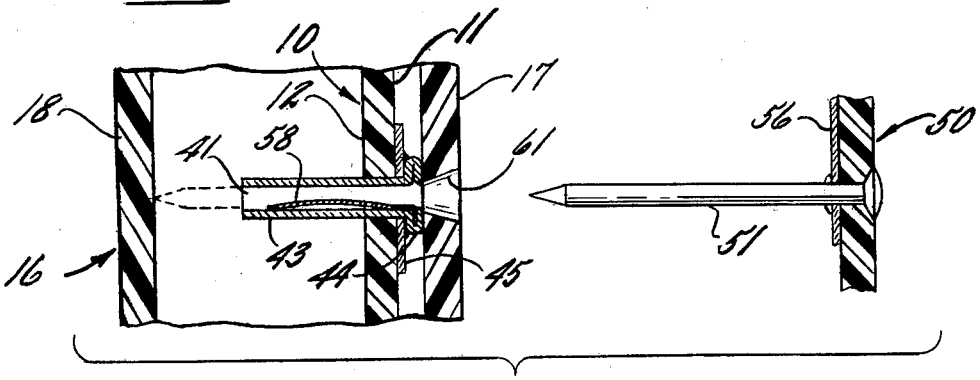
Figure 8:
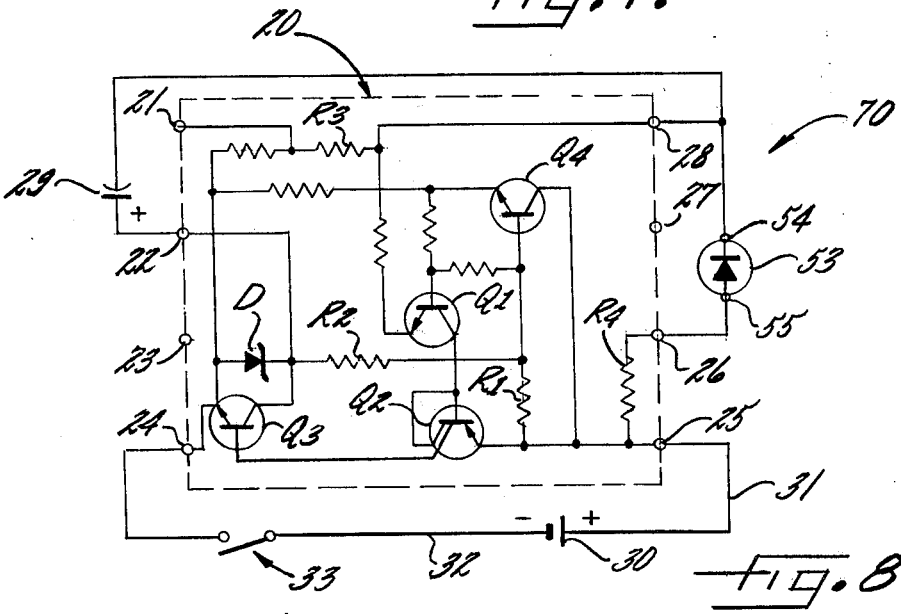

FIG. 2*a* is a view similar to FIG. 2 but showing the assembly used with a different piece of jewelry;

FIG. 3 is a sectional view showing the layout of the parts on a circuit board looking along line 3—3 in FIG. 1;

FIG. 4 is a view of the obverse side of the board showing the printed circuit and looking along line 4—4 in FIG. 1;

FIG. 5 is a vertical section looking along line 5—5 in FIG. 3;

FIG. 6 shows the back surface of the jewelry mounting plate viewed along lines 6—6 in FIG. 5;

FIG. 7 is a fragmentary enlarged cross section of a typical socket and associated pin with a back stop for shielding the point of the pin;

FIG. 8 is a circuit diagram of a typical solid state circuit which may be employed in practicing the invention.

Turning now to the drawing, the assembly includes a circuit board 10 having a front surface 11 and back surface 12, the circuit board being made in the form of wafer of the type generally used for printed circuits. The wafer is preferably of oval shape within an oval housing 16 in the form of a small plastic box having mated front and back portions 17, 18. The major dimension of the circuit board is preferably not greater than one inch.

Mounted on the circuit board is an integrated circuit module 20 having terminals 21–28 which coincide, in numbering, to the terminals set forth in the circuit diagram shown in FIG. 8. The module comprises an oscillator circuit to which reference will be made, having a capacitor 29 mounted in outboard position and having a battery 30 with positive and negative terminals 31, 32 respectively. Connected in series with the negative terminal 32 is an electrical switch 33 having an arm 34 which extends, for manipulation, through a slot in the wall of the housing 16. The output terminals of the oscillator, indicated at 41, 42, are in the form of a pair of sockets which are arranged parallel to one another on the back surface of the circuit board, presenting spaced pin-receiving openings at the front surface. The socket 41, taken by way of example, and which is shown in enlarged section in FIG. 7 includes a ferrule 43 which is formed with an integral flange 44 for soldering to the foil 45 on the circuit board 10.

In accordance with the present invention a jewelry mounting plate is provided which is made of insulating material of a size substantially smaller than the circuit board, with a light-emitting diode mounted on the face and having a pair of sharp, stiff pins of small diameter connected to the diode for reception in the respective sockets of the circuit board. Referring to FIGS. 5 and 6, the jewelry mounting plate, indicated at 50, is in the form of a small wafer of circuit board material having contact pins 51, 52 which are connected to a light-emitting diode 53 having contacts 54, 55. For completing the connection between the pins and the diode contacts, small patches of foil are provided on the mounting plate as indicated at 56, 57 (FIG. 6). The pins 51, 52 are preferably both stiff and sharply pointed. It is found that "dressmakers" pins, made of plated steel or bronze are ideal for the purpose, such pins being available in a length of ½ inch and with a gauge of 0.020 inch. For retaining the pins 51, 52 in the respective sockets 41, 42, each socket is preferably provided with an internal contact spring 58 which provides snug frictional engagement, thereby making the mounting plate 50 captive to the circuit board 10 when the pins are inserted while, at the same time, providing a low resistance electrical connection.

Preferably the pins 51, 52 are secured in the mounting plate 50 by forcible piercing, with the shank of the pin being supported during the piercing operation, and with each pin being inserted until its head is seated at the respective piece of foil, following which a dot of solder is applied. Adequate area is provided at 59 (FIG. 5) adjacent the light-emitting diode 53 for the mounting, by use of cement, of an unlimited variety of emblems or jewelry including the firefly motif shown in FIG. 2*a*.

In accordance with one of the detailed aspects of the invention the circuit board 10 is fully protected by the two halves 17, 18 of the housing, but the portion 17 of the housing is provided with beveled clearance openings 61, 62 (FIG. 7) in register with the sockets 41, 42 for guiding the pins 51, 52 into their inserted positions.

Thus in putting on the jewelry, for example, in a lapel, the jewelry is located upon the lapel with the mounting-contact pins 51, 52 oriented vertically, the pins being thrust through the fabric to project from the opposite side. The housing is then applied to the back side of the lapel, with the beveled clearance openings 61, 62 in a position to receive the pointed tips of the pins which are then thrust into seated position to complete the circuit and to make the two portions of the assembly securely captive. Applying the present illuminated jewelry to a ladies blouse is equally simple, the back side 18 of the case or housing serving as a limit stop for the pins 51, 52 so that the points of the pins do not create any hazard. The switch arm 34 is then thrown to the "on" position to energize the oscillator, causing the illuminating diode to flash periodically, for example, at intervals of a second or so.

One of the features of the construction which contributes to comfort and which insures against a telltale bulge in the fabric is the feature of pendulous suspension. This is accomplished by locating the sockets 41, 42 so that they are offset upwardly from the center of the circuit board and by mounting the battery 30, which is the heaviest part of the device, offset downwardly, so that the circuit board tends to hand pendulously from its region of support.

Turning next to the preferred form of circuit illustrated at 70 in FIG. 8, it will be noted that it includes transistors Q1–Q4, a zener diode D, and interconnecting resistors. Transistors Q4 is turned on all of the time but its emitter drain is exceedingly low. The capacitor 29 charges through resistors R1, R2 and R3. When the voltage across the capacitor reaches one volt, transistor Q1 begins to conduct. This turns on transistors Q2, Q3. The turning on of transistor Q3 establishes a capacitor discharge circuit through resistor R4, LED 53, capacitor 29, and battery 30, thereby to produce a flash of light. Since the capacitor voltage and battery voltage are additive upon discharge, the flash is brighter than that produced by battery alone, with the resistor R4 serving to limit the peak current. Following the discharge the capacitor again charges through resistors R1–R3, and the process is repeated, the period being dependent upon the RC product of capacitor 29 and resistor R3. Employing a capacitor of 100 microfarads and a resistance R3 of 9000 ohms, a flashing rate of slightly more than one flash per second is achieved.

It will be appreciated by one skilled in the art that the present invention is not limited to particular circuitry and the term "oscillator" as used herein is a general term covering any equivalent means for periodically turning the light-emitting diode on and off. In the simplest aspect of the invention a multivibrator could be employed, but it is preferred to use the more sophisticated circuit which is illustrated in FIG. 8. Such circuit has the advantage that energy is drawn from the battery during only a small fraction of the operating cycle, for example 1/100 of the cycle, thereby reducing the average power drain to only about 1% of that which would be drawn with steady state illumination of the diode. This makes it possible for a small hearing aid battery to operate a diode continuously in flashing condition for a period of several weeks. However since the device is inactivated whenever it is not in use, normal battery life is measured in terms of months rather than weeks. Indeed, in more limited usage, and employing a mercury type battery, life is extended to a year or more.

While it is one of the features of the present invention that the circuit board 10 is enclosed within a housing in the form of a small, conforming plastic box, it will be apparent to one skilled in the art that such enclosure is not essential to the invention and the circuit board, if desired, may be encapsulated or "potted" except for the replaceable battery 30, taking precautions, during encapsulation, to maintain the sockets 41, 42 open and accessible and to provide for free movement of the witch arm 34. In the encapsulated version of the present device a pair of battery contact springs, such as that indicated at 32 (FIG. 3) may be extended "outboard" in opposed position for confinement of a battery between them.

While it is preferred to employ a jewelry mounting plate made of a wafer of printed circuit board or other suitable insulating material, the expression "made of insulating material" includes alternate mounting plates in which a small amount of insulation is incorporated for the purpose of insulating at least one of the pins and one terminal of the diode.

I claim:

1. A flash assembly for clothing-supported jewelry comprising, in combination, a miniature circuit board having front and back surfaces, a pair of sockets arranged in parallel relation on the back surface and presenting spaced pin-receiving openings at the front surface, a jewelry mounting plate made of a flat piece of insulating material of a size substantially smaller than the circuit board and having a light-emitting diode projecting forwardly from the face thereof, the mounting plate having a pair of sharp, stiff pins of small diameter connected to the light-emitting diode, the pins being parallel to one another and spaced to coincide with the socket openings, the pins being in penetrating relation to the mounting plate and supported thereon cantilever fashion, a circuit module and battery on the back surface of the circuit board, the circuit module comprising an oscillator circuit having its input connected to the battery and its output connected to the sockets, a housing for the circuit board in the form of a flat box of plastic having a mated front and back closely fitted to the circuit board, the front of the box having clearance openings registering with the socket openings, the back of the box serving as a stop in the path of movement of the pins to preclude scratching of the user by the points of the pins, the sockets providing frictional retention for the pins so that upon entry of the pins into the sockets with a layer of clothing in between the housed circuit board and mounting plate are mutually captive and the light-emitting diode is electrically connected to the output of the oscillator for periodic flashing, the face of the mounting plate having sufficient surface to support a piece of jewelry in integrated relation with the light-emitting diode.

2. A flash assembly for clothing-supported jewelry comprising, in combination, a miniature circuit board, a pair of sockets arranged in parallel relation on the board and presenting spaced pin-receiving openings, a jewelry mounting plate made of a flat piece of insulating material of a size substantially smaller than the circuit board and having a light-emitting diode projecting forwardly from the face thereof, the mounting plate having a pair of sharp, stiff pins of small diameter connected to the light-emitting diode, the pins being parallel to one another and spaced to coincide with the socket openings, the pins being in penetrating relation to the mounting plate and supported thereon cantilever fashion, a circuit module and battery on the circuit board, the circuit module comprising an oscillator circuit having its input connected to the battery and its output connected to the sockets, a housing for the circuit board having a front and back closely fitted to the circuit board, the front of the housing having clearance openings registering with the socket openings, stop means to limit movement of the pins to preclude scratching of the user by the points of the pins, the sockets providing frictional retention for the pins so that upon entry of the pins into the sockets with a layer of clothing in between the housed circuit board and mounting plate are mutually captive and the light-emitting diode is electrically connected to the output of the oscillator for periodic flashing, the face of the mounting plate having sufficient surface for supporting a piece of jewelry in integrated relation with the light-emitting diode.

3. The combination as claimed in claim 2 in which the circuit board has a switch connected to the battery and in which the switch has an operator which is extended for convenient manipulation through the housing.

4. A flash assembly for clothing-supported jewelry comprising, in combination, a flat supporting member, a pair of sockets arranged in parallel relation perpendicular to the plane of the supporting member and presenting spaced pin-receiving openings, a jewelry mounting plate made of insulating material of a size substantially smaller than the supporting member and having a light-emitting diode seated on the mounting plate and projecting forwardly from the face thereof, the mounting plate having a pair of sharp, stiff pins of small diameter connected to the light-emitting diode, the pins being parallel to one another and spaced to coincide with the socket openings, the pins being secured to the mounting plate cantilever fashion, a circuit module and battery on the supporting member, the circuit module comprising an oscillator circuit having its input connected to the battery and its output connected to the sockets, the sockets providing frictional retention for the pins so that upon entry of the pins into the sockets with a layer of clothing in between, with the supporting member, sockets, circuit module and battery all hidden behind the layer of clothing, the supporting member and mounting plate are mutually captive and the light-emitting diode is electrically connected to the oscillator for periodic flashing, the face of the mounting plate having sufficient surface to support a piece of jewelry in integrated relation with the light-emitting diode.

5. The combination as claimed in claim 4 in which the sockets are offset upwardly in one direction from the center of the circuit board and the battery is offset in the opposite direction so that the circuit board hangs pendulously from the pins.

* * * * *